US006450763B1

(12) United States Patent
Crum et al.

(10) Patent No.: US 6,450,763 B1
(45) Date of Patent: Sep. 17, 2002

(54) REPLACEABLE VARIABLE STATOR VANE FOR GAS TURBINES

(75) Inventors: Gregory Allan Crum, Greenville; Lynn Charles Gagne, Simpsonville; William Earl Dixon, Greer, all of SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/715,278

(22) Filed: Nov. 17, 2000

(51) Int. Cl.[7] ..... F01B 25/02; F01B 1/02; B21K 25/00

(52) U.S. Cl. ..... 415/160; 415/209.4; 29/889.22

(58) Field of Search ..... 415/160, 209.4, 415/210.1; 416/160, 214 R, 159, 214 A; 29/889.1, 889.21, 889.22

(56) References Cited

U.S. PATENT DOCUMENTS

| | | | | |
|---|---|---|---|---|
| 3,269,701 A | * | 8/1966 | Miller et al. | 415/209.4 |
| 3,788,763 A | * | 1/1974 | Nickles | 415/147 |
| 3,964,530 A | * | 6/1976 | Nickles | 411/195 |
| 4,141,124 A | * | 2/1979 | Ryan | 29/889.1 |
| 4,169,692 A | * | 10/1979 | McDonough et al. | 415/160 X |
| 4,834,616 A | * | 5/1989 | Kasarsky et al. | 416/229 R |
| 4,950,129 A | | 8/1990 | Patel et al. | |
| 5,024,580 A | * | 6/1991 | Olive | 415/162 X |
| 5,211,537 A | * | 5/1993 | Langston et al. | 415/209.2 |
| 5,281,087 A | | 1/1994 | Hines | |
| 5,560,841 A | * | 10/1996 | DeMichael et al. | 219/85.1 |

* cited by examiner

*Primary Examiner*—John E. Ryznic
(74) *Attorney, Agent, or Firm*—Nixon & Vanderhye P.C.

(57) ABSTRACT

A method of replacing an inlet guide vane from a lower inlet casing of a compressor, the lower inlet casing adapted to be secured to an upper inlet casing at a horizontal joint, and after removal of the upper half of the inlet casing but with a rotor of the compressor remaining in place, wherein the inlet guide vane is supported between radially inner and outer walls of the lower inlet casing, and further wherein the inlet guide vane is formed with an integral stem that extends radially through the outer wall and supports a drive gear on its outer end that engages an annular gear rack, the method including a) removing the gear on the radially outer end of the integral stem of the inlet guide vane; b) shearing the inlet guide vane into two cut portions; c) removing the cut portions from inside the lower inlet casing; and d) replacing the inlet guide vane by a modified inlet guide vane having a two-piece stem assembly that enables installation without removal of the rotor. A new inlet guide vane assembly is provided for replacing the vane. The new assembly includes a vane having a cylindrical stub at a radially inner end thereof and a relatively short integral stem at a radially outer end thereof; a jack shaft adapted for connection at a radially inner end thereof to a radially outer end of the integral stem such that torque applied to the jack shaft is transmitted to the vane, a radially outer end of the jack shaft adapted to receive a drive gear. An outer stem piece is seated on the jack shaft and welded to the drive gear to complete a torque transmission path from the drive gear to complete a torque transmission path from the drive gear to the vane.

9 Claims, 3 Drawing Sheets

(PRIIOR ART)

REPLACEABLE VARIABLE STATOR VANE FOR GAS TURBINES

This invention relates to turbo machinery and, specifically, to a new variable stator vane construction for a turbine compressor and related method for removal of existing variable stator vanes an d replacement with the new vanes, without having to remove the turbine rotor.

BACKGROUND OF THE INVENTION

Axial compressors used in gas turbines of the assignee's product line may include as many as eighteen (18) stages, each comprising a bladed disk. In addition, a circumferential array of variable guide vanes are provided at the compressor inlet. The latter serve to adjust the airflow at start-up and provide higher firing temperature at reduced load for regenerative-cycle and combined-cycle applications. These inlet guide vanes are gear actuated from outside the inlet casing, using an annular drive ring, a geared rack, and a drive gear to turn the vanes in unison during operation.

Specifically, the inlet guide vanes are supported in two semi-annular halves, referred to herein as the upper and lower inlet casings. In the illustrative example, four inlet guide vanes are supported in each of eight support segments bolted to the lower inlet casing. While removal and replacement of the inlet guide vanes in the upper inlet casing can be accomplished relatively easily while the upper inlet casing is removed, removal and replacement of the inlet guide vanes in the lower inlet casing, without removal of the rotor, is problematic, due primarily to the extended axial length of the vanes. The latter is necessitated by the requirement that the vane adjustment drive be located outside the casing. Thus, each of the vanes have an integral, extended drive stem that extends through the casing where it mounts the drive gear for engagement with the annular geared rack fixed to the annular drive ring. Removal of the rotor has been required to create the necessary space to remove these extended vanes. The process, however, is complex, time consuming and expensive.

BRIEF SUMMARY OF THE INVENTION

This invention relates to a technique for removing conventional inlet guide vanes, and to a new replacement inlet guide vane assembly that allows reinstalling of the inlet guide vanes in the lower half of the inlet casing, both removal and reinstallation achievable without removing the rotor.

Removal of a conventional inlet guide vanes in accordance with this invention involves removing the external drive gears from the guide vanes in the lower inlet casing, and then cutting the vanes, allowing both cut pieces of each guide vane to be removed from inside the lower inlet casing. This removal procedure is followed for the inlet guide vanes mounted in each of the support segments in the lower inlet casing, segment by segment. Installation of replacement inlet guide vanes without removal of the rotor requires modification of the existing inlet guide vane design, as described further below.

The radially outer, or drive end, of each guide vane will now include a multi-piece drive stem assembly. The shortened radial length of the guide vane stems enables each guide vane to be manually located within the casing, while the additional hardware, including an intermediate jack shaft, drive gear and outer stem piece, may be assembled from outside the inlet casing. That portion of the drive stem integral with the vane has been radially shortened and is provided with splines and flats that mate with a complementary recess in the intermediate jack shaft. The other end of the jack shaft slidably receives the drive gear. An outer stem piece is adapted for installation on the free end of the jack shaft, projecting beyond the drive gear, again with torque-transmitting flats (or hex-shaped head or similar). A radial screw extends from the outer stem piece through the jack shaft, and is threadably receivable in the vane stem, for loosely holding the components together. After all of the vanes are adjusted to the appropriate vane angle, the radial screws are tightened and the outer stem pieces are welded to the drive gear, thus creating a torque transmission path between the drive ring, geared rack, drive gears and the guide vanes.

Thus, in one aspect, the invention relates to a method of replacing an inlet guide vane from a lower inlet casing of a compressor, the lower inlet casing adapted to be secured to an upper inlet casing at a horizontal joint, wherein the inlet guide vane is supported between radially inner and outer walls of the lower inlet casing, and further wherein the inlet guide vane is formed with an integral stem that extends radially through the outer wall and supports a gear on its outer end that engages an annular gear rack, the method comprising:

a) removing the gear of the radially outer end of the integral stem of the inlet guide vane;

b) shearing the inlet guide vane into two cut portions;

c) removing the cut portions of the inlet guide vane from inside the lower inlet casing; and d) replacing the inlet guide vane by a modified inlet guide vane having a two-piece stem assembly that enables installation without removal of the rotor.

In another aspect, the invention relates to an adjustable inlet guide vane assembly comprising a vane having a cylindrical stub at a radially inner end thereof and a relatively short integral extension stem at a radially outer end thereof; a jack shaft adapted for connection at a radially inner end thereof to a radially outer end of the integral stem such that torque applied to the jack shaft is transmitted to the vane, a radially outer end of the jack shaft adapted to receive a drive gear.

DETAILED DESCRIPTION OF THE INVENTION

Figure 1:
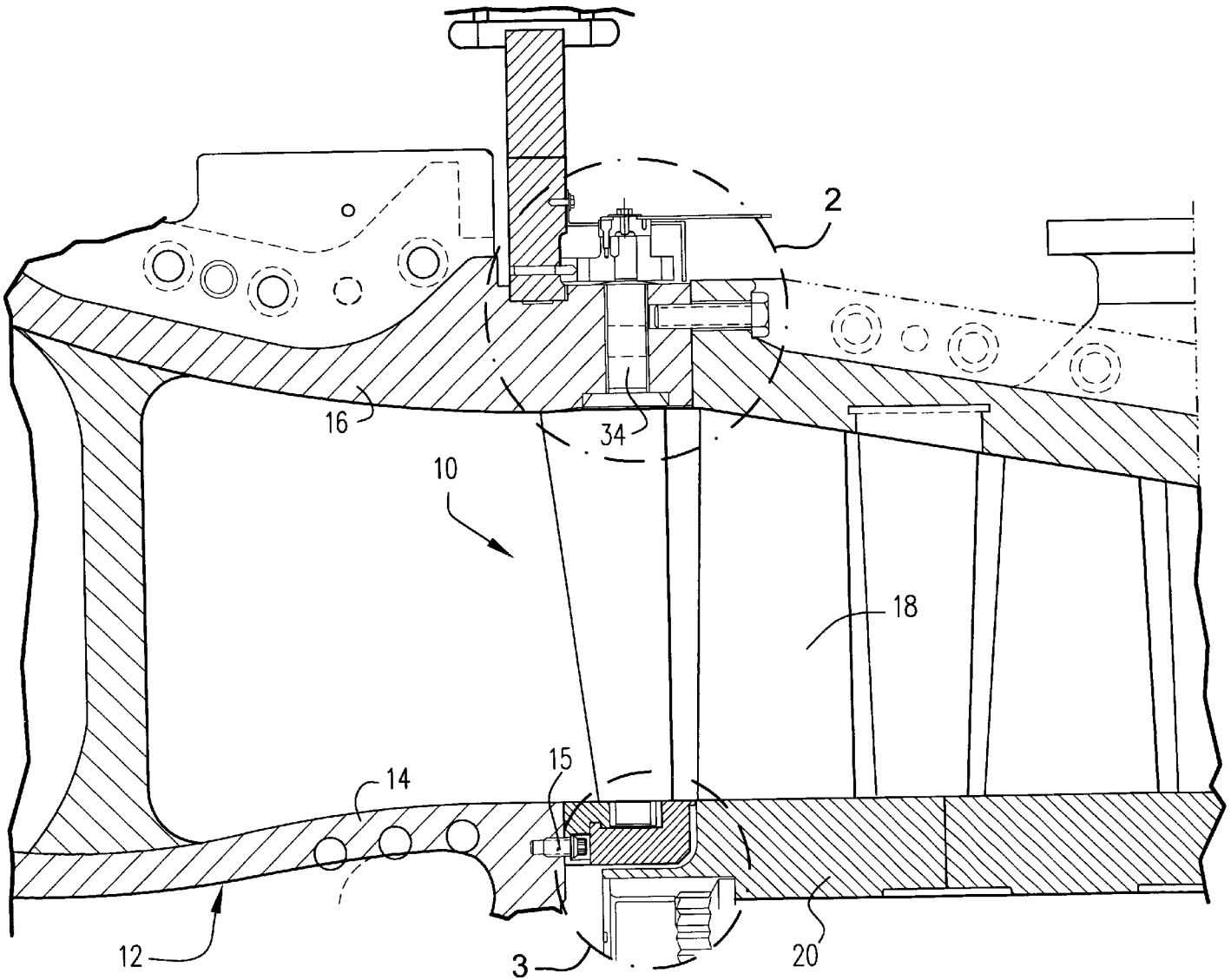
FIG. 1 is a partial plan view, partly in section, of the lower half of an inlet casing of an axial compressor, taken approximately at the horizontal joint, and illustrating the manner in which the inlet guide vanes are assembled inside an inlet casing.
Figure 3:
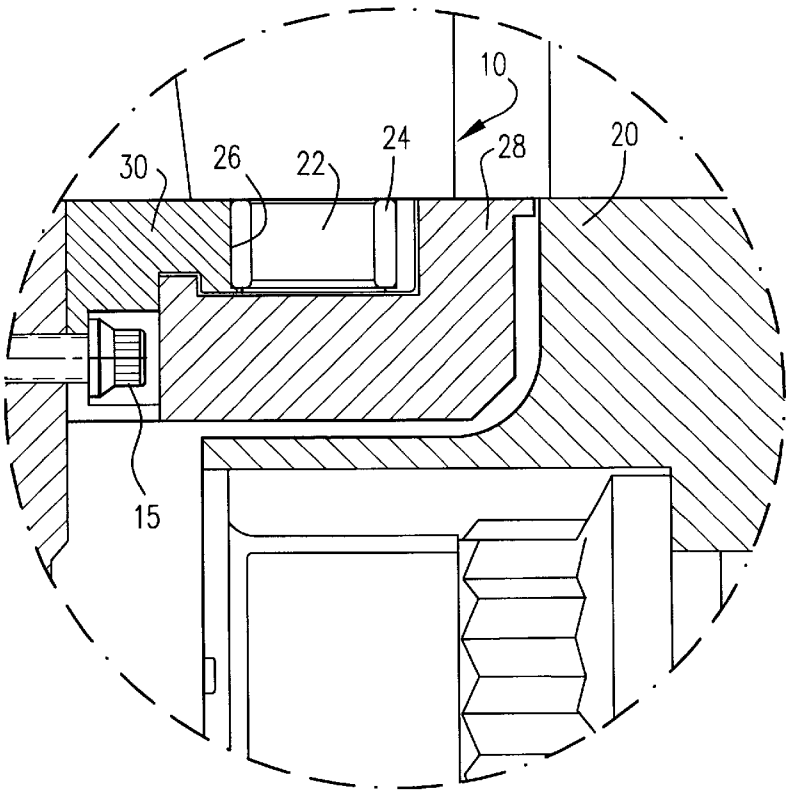
Fig.3 (PRIOR ART)
FIG. 3 is an enlarged detail of the radially inner end of the vane, taken from FIG. 1.
Figure 2:
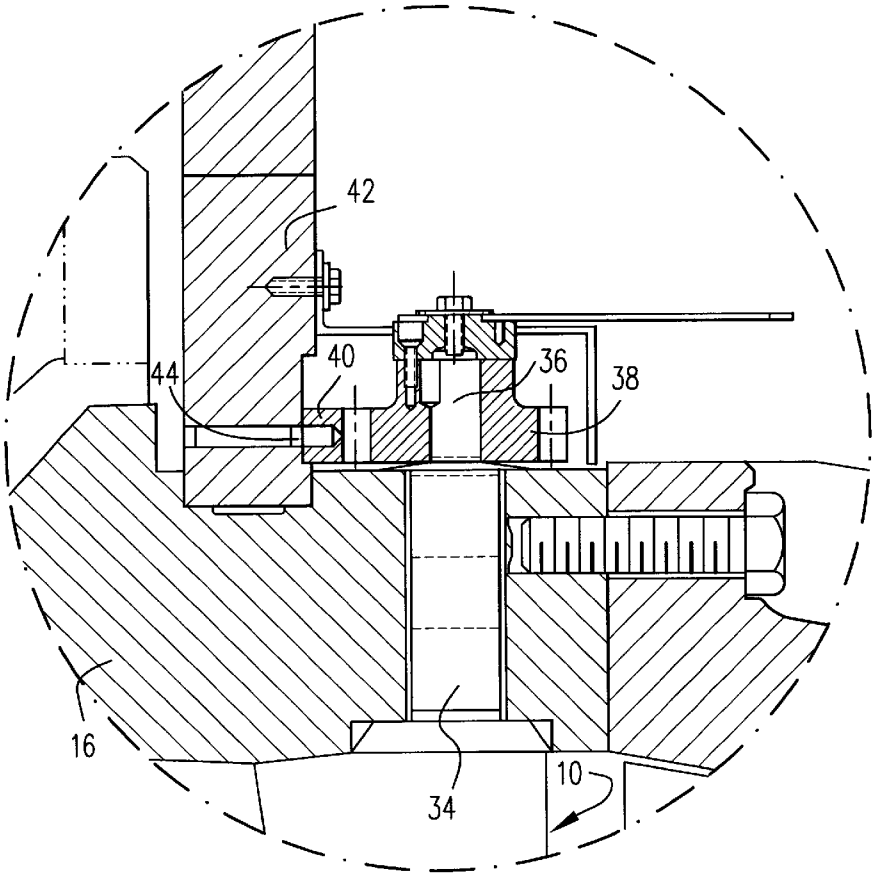
Fig.2 (PRIOR ART)
FIG. 2 is an enlarged detail of the radially outer end of the vane, taken from FIG. 1.

With reference to FIG. 1, an inlet guide vane 10 of known construction is supported within a lower inlet casing 12, between radially inner and outer walls 14, 16, respectively. An annular array of the inlet guide vanes is located forward of the zero or first compressor stage 18, surrounding the rotor 20 (partially shown). It will be appreciated that the inlet casing is split into an upper and lower casings, each extending substantially 180°, and each supporting half of the inlet guide vanes. The upper and lower casings are joined together at a horizontal joint. The views shown in all of the Figures are understood to be taken through the lower inlet casing 12, adjacent the horizontal joint.

The radially inner end of each of the inlet guide vanes 10 is formed with a cylindrical stem or stub shaft 22 that is supported in a bushing 24 seated within a hole 26 formed in a support segment 30. It will be understood that by supporting the vanes in this manner within the bushings 24 in holes 26, they are adjustably rotatable about the stub shafts 22. There are eight support segments 30 in the lower inlet casing, collectively extending through substantially 180°. These segments lie axially opposite a semi-annular rub ring 28. In the exemplary embodiment, each support segment 30 accommodates four vanes 10. The support segments 30 are individually bolted to the inner casing wall 14 by bolts 15. The rub ring 28 is unsupported in the lower inlet casing, and is thus able to be installed and removed by simply "rolling" the ring into or out of the lower casing.

The radially outer end of each guide vane is formed with an integral extension stem 34 that extends through a bore in the outer casing wall 16, with a reduced diameter portion 36 mounting a drive gear 38. The drive gear 38 meshes with an annular gear rack 40 secured to a drive ring 42 (by, e.g., bolts 44) powered by a hydraulic cylinder (not shown). The drive gear 38 is secured to the shaft portion 36 via a key (or shear pin) and set screw (or other suitable means).

When the guide vanes are to be replaced, they can be removed from the lower inlet casing in the following manner. With the upper half of the inlet casing removed, the individual drive gears 38 are removed, and the inlet guide vanes are then sheared in two, so that the pieces can be removed from inside the lower casing half. Note that, with the gear 38 removed, the upper or radially outer piece, including the stem 34 can be pulled into the casing and then removed, while the lower or radially inner piece can be pulled out of a respective bushing 24.

It will be appreciated that to install new guide vane assemblies without removing the rotor, the inlet guide vane assemblies as described above must be altered.

Figure 5:
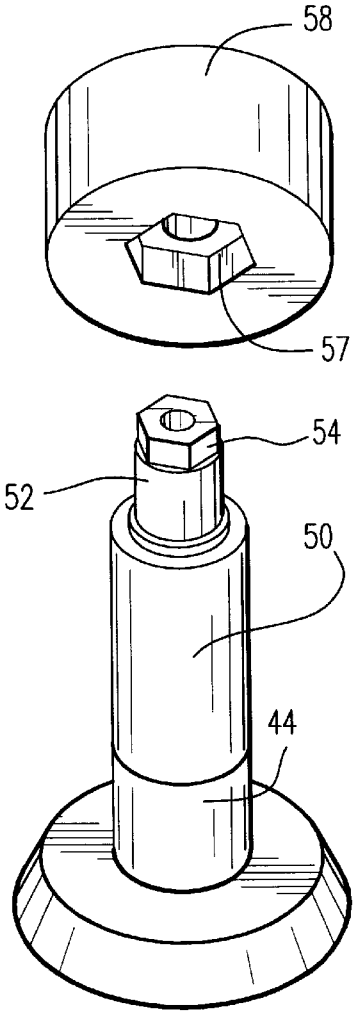
FIG. 5 is an exploded perspective view of a jack shaft and an outer stem piece incorporated in the inlet guide vane of FIG. 4.
Figure 4:
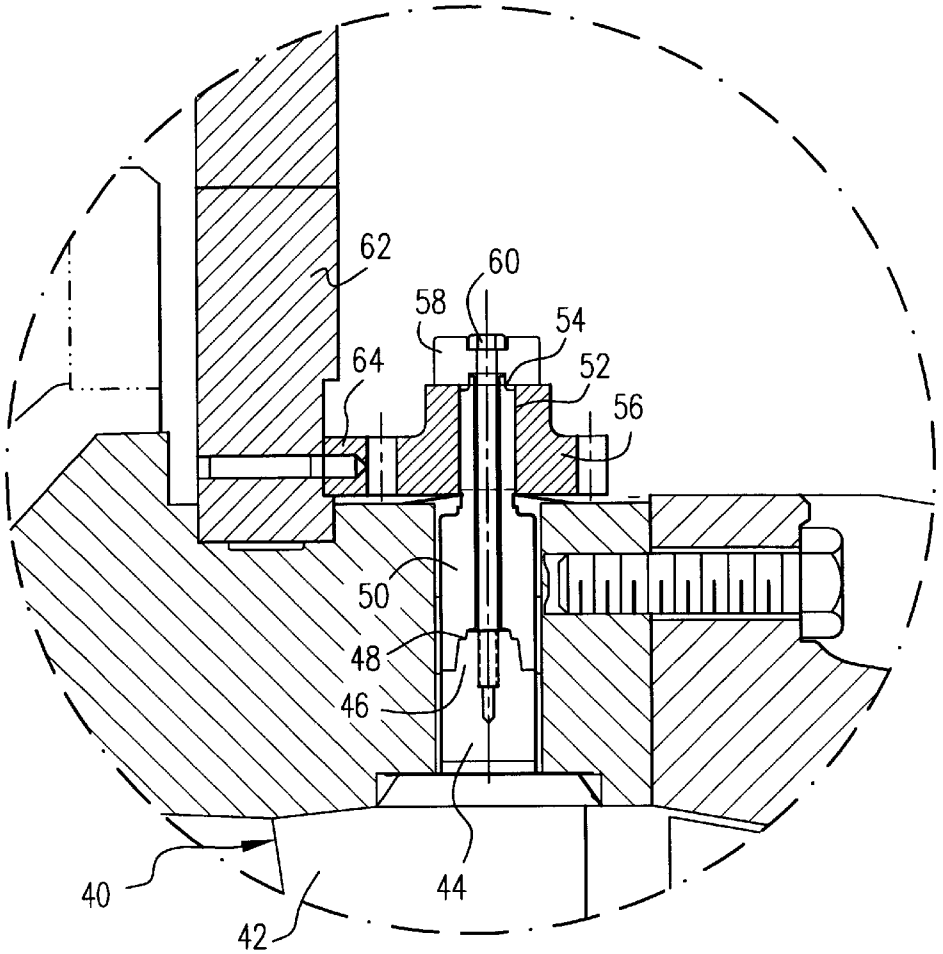
FIG. 4 is a partial cross-section of the radially outer end of a new inlet guide vane in accordance with this invention.

The radially outer end of the new replacement inlet guide vane 40 in accordance with this invention is shown in FIGS. 4 and 5. The radially inner end of the guide vane, and the manner in which it is supported in the inner casing wall 14 remains as in the conventional construction described above, i.e., with a stub shaft 22 received in a bushing 24 seated in a hole 26 in a respective support segment 30. The radially outer end 42 of the vane 40 includes an integral, radial stem 44 having a conical splined portion 46 with flats 48. An intermediate jack shaft 50 has a radially inner end with mating splines and flats, thus providing torque transmission capability between the intermediate jack shaft 50 and the vane 40. An outer end of the jack shaft 50 is formed with a smooth shaft portion 52 that receives the drive gear 56. As best seen in FIG. 5, outermost end 54 of the jack shaft 50 that extends beyond the drive gear is hex-shaped so that it can receive a similarly hex-shaped recess 57 of an outer stem piece 58, thus providing torque transmission capability between all three components 44, 50 and 58. The outer stem piece 58, drive gear 56 and jack shaft 50 are secured to the vane stem 44 via bolt or screw 60 threadably received in the vane stem 44.

To install the new vanes 40, the rub ring 28 is removed, permitting access to the support segments 30. The segments 30 are removed, progressively from the horizontal joint to a bottom dead center position, from each side of the horizontal joint. The modified inlet guide vanes 40 are loaded into the bore of the outer casing wall 16, one vane at a time, beginning at the bottom dead-center location. Once four inlet guide vanes 40 are loaded into the outer casing 16, one support segment 30 is installed with the stub shaft 22 being inserted into bushing 24 in holes 26. Assembly progresses in this manner, working from bottom dead center toward the horizontal joint until all support segments 30 are installed. After all of the segments 30 have been re-bolted to the casing inner wall 16, the rub ring 28 is re-installed. The intermediate jack shaft 50, drive gear 56 and outer stem piece 58 are then assembled on each guide vane, from outside the casing. Screws or bolts 60 are then threaded into the various vane stems 44 to loosely hold the assemblies together. The upper inlet casing (not shown) is then re-installed, and all of the inlet guide vanes are rotationally aligned to the desired vane angle. The screws 60 are then tightened and the outer stem pieces 58 are welded to the respective drive gears 56, thus completing the torque transmission path between the drive ring 62, rack 64, drive gears 56 and vanes 40.

It will be appreciated that by having a multi-piece vane assembly, installation in the limited space between the lower inlet casing and the rotor is possible. At the same time, the required torque transmission path is established for uniformly adjusting all vane angles simultaneously.

It will also be appreciated that while normally all of the inlet guide vanes would be replaced, the removal and installation technique as described herein may also be used to replace a single worn or damaged blade.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of replacing an inlet guide vane from a lower inlet casing of a compressor, the lower inlet casing adapted to be secured to an upper inlet casing at a horizontal joint, and after removal of the upper half of the inlet casing but with a rotor of the compressor remaining in place, wherein the inlet guide vane is supported between radially inner and outer walls of the lower inlet casing, and further wherein the inlet guide vane is formed with an integral stem that extends radially through the outer wall and supports a drive gear on its outer end that engages an annular gear rack, the method comprising:

a) removing the gear on the radially outer end of the integral stem of the inlet guide vane;

b) shearing the inlet guide vane into two cut portions;

c) removing the cut portions from inside the lower inlet casing; and d) replacing said inlet guide vane by a modified inlet guide vane having a two-piece stem assembly that enables installation without removal of the rotor.

2. The method of claim 1 wherein steps a), b) and c) are repeated for all inlet guide vanes in the lower inlet casing, starting from one or both sides of the horizontal joint, followed by replacement of all of said inlet guide vanes according to step d).

3. The method of claim 1 wherein a radially inner end of the inlet guide vane is supported in a bushing provided in one of a plurality of removable segments secured to the radially inner wall of the lower inlet casing.

4. An adjustable inlet guide vane assembly comprising:

a vane having a cylindrical stub at a radially inner end thereof and a relatively short integral stem at a radially outer end thereof;

a jack shaft adapted for connection at a radially inner end thereof to a radially outer end of said integral stem such that torque applied to said jack shaft is transmitted to said vane, a radially outer end of the jack shaft adapted to receive a drive gear.

5. The adjustable inlet guide vane assembly of claim 4 including an outer stem piece engagable with said drive gear and with said jack shaft, such that torque applied to said jack shaft is transmitted to said vane.

6. The adjustable inlet guide vane assembly of claim 5 wherein a portion of said jack shaft is smooth so as to slidably receive the drive gear.

7. The adjustable inlet guide vane assembly of claim 4 in combination with a lower inlet casing of a compressor, wherein radially inner ends of a plurality of said vanes are seated in one or more segments fixed to an inner wall of the lower inlet casing.

8. The adjustable inlet guide vane assembly of claim 7 wherein said jack shaft extends through an outer casing wall and a drive gear is seated on said jack shaft, and an outer stem piece is seated on said jack shaft and welded to said drive gear.

9. The adjustable inlet guide vane assembly of claim 8 including a bolt extending radially between the outer stem piece and the integral stem.

* * * * *